United States Patent [19]

Misono

[11] 4,350,924

[45] Sep. 21, 1982

[54] COLOR PICTURE TUBE

[75] Inventor: Masayoshi Misono, Choseimura, Japan

[73] Assignee: Hitachi, Ltd., Tokyo, Japan

[21] Appl. No.: 85,254

[22] Filed: Oct. 16, 1979

[51] Int. Cl.[3] ..... H01J 29/46

[52] U.S. Cl. ..... 313/441; 313/445; 313/457

[58] Field of Search ..... 313/441, 444, 445, 446, 313/447, 448, 449, 451, 479, 456, 457

[56] References Cited

U.S. PATENT DOCUMENTS 4,153,857 5/1979 Delsing et al. ..... 313/479

FOREIGN PATENT DOCUMENTS 53-113055 9/1978 Japan .

*Primary Examiner*—Ernest F. Karlsen

*Attorney, Agent, or Firm*—Craig and Antonelli

[57] ABSTRACT

A color picture tube with an in-line multi-stage focusing type electron gun assembly which can suppress generation of spark discharges and which can be improved in withstand voltage characteristics. The electron gun assembly comprises a metallic shielding member facing the fluorescent screen and maintained at the anode potential. The shielding member is displaced, in the direction of a tube axis and toward the base, from an edge facing the base of an inner graphite coating formed on the inner wall of the neck tube by a predetermined distance or more. The metallic shielding member shields electrostatically the edge of the inner graphite coating from the grid electrodes and cathode electrode close to the base and at lower potentials. At least one of focusing voltage feed conductors for third and fifth grid electrodes is wired so as to run through a gap between the inner wall of the neck tube and a bead glass for supporting the electrodes of the electron gun assembly.

9 Claims, 24 Drawing Figures

COLOR PICTURE TUBE

This invention relates to a color picture tube with an in-line multi-stage focusing type electron gun assembly which is improved in withstand voltage characteristics and in particular, a color picture tube with an in-line multi-stage focusing electron gun assembly which can suppress generation of spark discharges at low cost and which can be improved in withstand voltage characteristics.

In accordance with the invention, a metallic shielding member, a sixth grid or a shield cup, which is one of members constituting the electron gun assembly being disposed to a fluorescent screen side and subject to the application of the anode potential, is displaced in the direction of tube axis and toward the base of the tube a predetermined distance or more away from an edge of an inner graphite coating formed on the inner wall of a tube envelope i.e., a neck tube. Such a member constituting the electron gun assembly opposes the inner wall of the neck tube with a small gap therebetween so that the inner graphite coating edge can be shielded electrostatically from members of the electron gun assembly facing the base and being maintained at lower potentials by means of the metallic shielding member, the sixth grid or the shield cup held at the anode potential. In addition, at least one of conductors for feeding focusing voltages to third and fifth grid electrodes is so wired as to run through a gap between the inner wall of the neck tube and a bead glass for supporting the electrodes of the electron gun assembly.

The invention will be further described with reference to the accompanying drawings in which.

In the drawings, like reference numerals refer to like parts.

Figure 1:
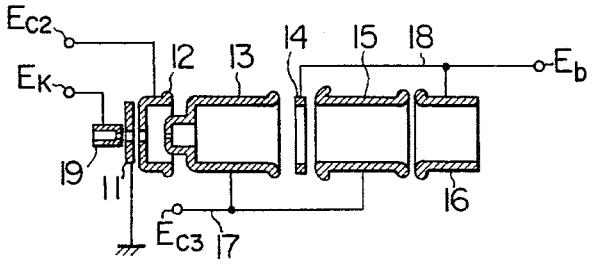
FIG. 1 is a schematic longitudinal section view of an electron gun assembly for a color picture tube having first to sixth grid electrodes.

An electron gun assembly as shown schematically in FIG. 1 comprises a first grid electrode 11, a second grid electrode 12, a third grid electrode 13, a fourth grid electrode 14, a fifth grid electrode 15, a sixth grid electrode 16, a feed conductor 17 for applying a focusing voltage $E_{c3}$ to the third and fifth grid electrodes, a feed conductor 18 for applying an anode voltage $E_b$ (which is identified as the maximum voltage applied to a color picture tube as a practice), and a cathode electrode 19. This electron gun assembly can establish a plurality of main lenses and attain good focusing characteristics. In order to produce bright and high-resolution pictures, the anode voltage $E_b$ is required to be high, usually amounting to 25 to 30 KV. The focusing voltage $E_{c3}$ is approximately 30% of $E_b$. A voltage $E_{c2}$ applied to the second grid electrode 12 is 400 to 700 V, the first grid electrode 11 is grounded, and a signal voltage $E_k$ of less than 200 V which varies with the brightness of the individual picture elements is applied to the cathode electrode 19. The third, fourth, fifth and sixth grid electrodes are spaced from the adjoining grid electrodes by a minimum distance of about 1 mm so that an electric field of high intensity can be produced at gaps between the adjoining grid electrodes. Because of the narrow gap, the electron will collide with molecules of residual gas at a low probability and besides, it will not be so accelerated as to collide with the gas molecules at a velocity sufficient to ionize them. An avalanche ionization by no means occurs. As a result, only a dark current will flow through the gap between the adjoining grid electrodes, preventing spark discharges from being generated. In other words, old, wellknown Paschen's law stands with the minimized distance between the electrodes, showing increase in withstand voltage therebetween. This is true for the gap between the second and third grid electrodes, and so on. Electrons emitted from the cathode electrode of the electron gun assembly unit partly impinge on the electrode surface or insulator surface and are reflected therefrom, or otherwise hit out such a surface to produce secondary electrons. These electrons are called stray electrons. The stray electrons partly deposit on insulative surfaces such as bead glass surface and inner wall of the glass neck tube so as to charge thereon since the insulative surfaces prevent the electrons deposited thereon to be moved and neutralized. The mobility of the charge depends directly on cleanness or, conversely, contamination of the insulative surfaces and even if color picture tube manufacturing processes are managed to be in good conditions, it is inevitable that charging state on the insulative surfaces near the electron gun assembly unit in one product is different from that in another product.

Figure 2A:
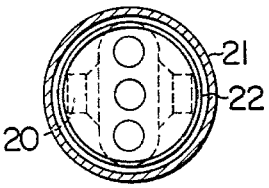
FIG. 2A is a crossectional view of a neck tube to show the electron gun assembly mounted therein.
Figure 2B:
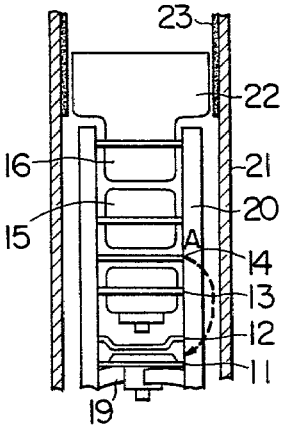
FIG. 2B is a fragmentary longitudinal section view of the neck tube to show the electron gun assembly mounted therein.

The electron gun assembly unit shown in FIG. 1 is mounted in the envelope of color picture tube as shown in FIGS. 2A and 2B and its electrodes are applied with predetermined voltages. Then, irrespective of the charging state, a spark discharge will break out from the fourth grid electrode 14 and run along a path A as shown in FIG. 2B by thick dashed line passing through a gap between a bead glass 20 and the inner wall of a neck tube 21, thereby bridging the fourth grid electrode and the second and third grid electrodes or the cathode electrode over the third grid electrode 13. This spark discharge usually disappears in a short time but reoccurs after a time has elapsed from the disappearance. During the spark discharge, pictures are of course disturbed and if the duration of the discharge is prolonged, DC power sources and the color picture tube itself will be damaged. Therefore, it is necessary in designing the color picture tube to estimate a sufficient tolerance against the spark discharge. In FIGS. 2A and 2B, reference numeral 22 designates a shield cup and 23 an inner graphite coating.

Figure 3A:
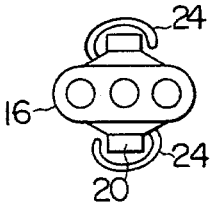
FIG. 3A PRIOR ART
FIG. 3A is a plan view of a prior art electron gun assembly mounted with shield wires.
Figure 3B:
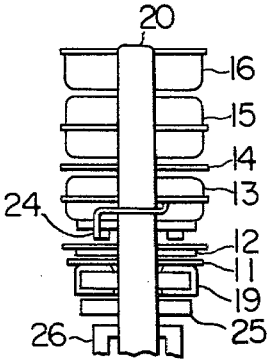
FIG. 3B PRIOR ART
FIG. 3B is a front view of the electron gun assembly of FIG. 3A.

To prevent the generation of the spark discharge, an electrically conductive shield wire 24 as shown in FIGS. 3A and 3B has conventionally been employed which is mounted to the third grid electrode 13 to surround the rear surface (opposite to the surface abutting against the electrodes) of the bead glass 20. Such a shield wire is disclosed in Japanese utility model application No. 18712/'77 laid open to public on Sept. 8, 1978 (laid open No. 113055/'78). In FIG. 3B, reference numeral 25 designates a mount support and 26 a heater lead strap. The other components are designated by the same reference numerals as those in FIGS. 2A and 2B. It is an old and familiar expedient to dispose a metallic member of a suitable form (wire or plate) at a suitable site between two electrodes at high potential difference for the sake of forming, in the electric field, a desired equi-potential region which desirably controls the field distribution such that highly intensive field responsible for triggering the spark discharge can be eliminated. Apart from various assumptive reasons that the shield wire 24 can shield the electric field directed from the fourth grid electrode 14 toward the electrodes at lower potential and can absorb the stray electrons to change the charging state on the bead glass rear surface and on the inner wall of the neck tube, it has been proved experimentally that the shield wire 24 can suppress the generation of spark discharge. Products with the shield wire 24 were operated and some of them underwent discharge only a few times at the initial phase of applying voltages at the worst but almost all of them experienced no spark discharge. In contrast, products without the shield wire placed in operation underwent periodically repetitive spark discharges.

Figure 4:
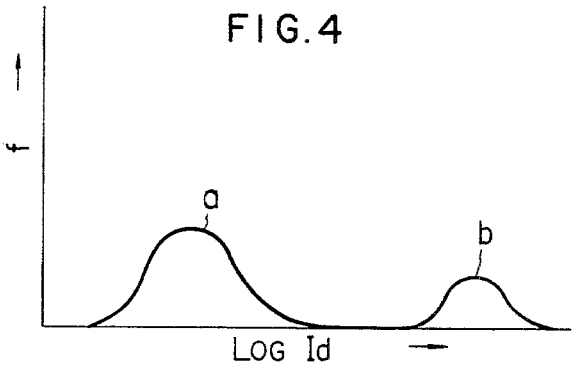
FIG. 4 is a graphic representation showing distributions of the number of examined color picture tubes with respect to measured values of the dark current.

Another problem is however encountered in the electron gun assembly unit with the shield wire. More particularly, a great number of color picture tubes with the shield wire were examined to measure dark current Id which flows through a gap between the electrode at the anode potential and the electrode at the focusing potential. Results were arranged to show the relation between the number f of the examined tubes and logarithmic values of dark current Id as shown in FIG. 4 and two peaks of distribution (a) and (b) of the number f having different peak values at two specified logarithmic values were observed. One specified logarithmic value corresponding to the peak of the distribution (b) was approximately double figures as large as the other specified logarithmic value corresponding to the peak of the distribution (a). With picture tubes exhibiting the large dark current associated with the distribution (b), although these tubes being mounted with the shield wire, spark discharge was liable to occur more frequently than with picture tubes exhibiting the small dark current. This experimental result was further studied to find that the picture tubes exhibiting the large dark current had occurred after "knocking treatment" thereof. As well known in the art, in order to protect color picture tubes in use from undergoing the spark discharge, "knocking treatment" is carried out wherein voltages which are 2 to 3 times the working voltages are applied to the electrodes of the picture tube so that spark discharge is intentionally caused to thereby burn out foreign matters within the tube such as fiber trash and fine protrusions on the contour of the electrodes. Accordingly, during knocking treatment, a spark discharge as shown in FIG. 5B by thick dashed line, for example, takes place, and an edge B of the inner graphite coating 23 which is applied with a voltage 2 to 3 times as large as the working anode voltage is bombarded with a great number of electrons of high kinetic energy stemming from the spark discharge and is sputtered. Supposedly, the thus sputtered edge B of the inner graphite coating 23 takes the form of powders, which powders are deposited on surfaces of the electrodes and bead glass 20 of the color picture tube to produce the large dark current associated with the distribution (b) as shown in FIG. 4. It is further supposed that not only the sputtered graphite powders increase the dark current but also the graphite powders deposited on the electrodes form projecting edges thereon since the status of deposited graphite powders varies with vibrations and shocks as well as, because of the graphite powders being electrically conductive, with voltages applied and consequently, electric field is concentrated at the projecting edges to induce spark discharges, thereby leading to the fact that with picture tubes exhibiting the large dark current, the spark discharge tends to occur.

Figure 5A:
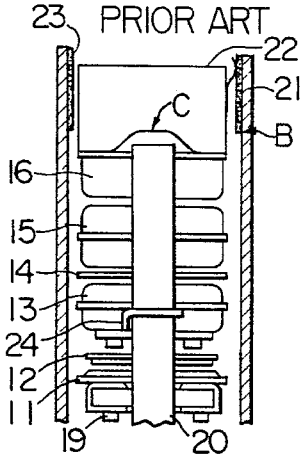
FIG.5A PRIOR ART
FIG. 5A is a diagrammatic representation to show a discharge occurring in a prior art color picture tube during knocking treatment by depicting the front of an electron gun assembly mounted in the envelope of the tube.
Figure 5B:
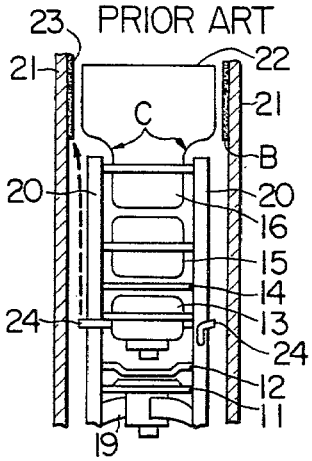
FIG.5B PRIOR ART
FIG. 5B is a similar view to FIG. 5A depecting the side of the electron gun assembly.

In FIGS. 5A and 5B, character C denotes a recessed portion of the shield cup 22 along which the bead glass 20 extends.

In addition to the disadvantages set forth above, the provision of the shield wire increases the number of parts, prolongs the electron gun assembling process and raises cost.

It is an object of this invention to provide a color picture tube with an in-line multi-stage focusing type electron gun assembly which can prevent the sputtering of inner graphite powders when spark discharge is caused during the knocking treatment, thereby improving withstand voltage characteristics.

It is another object of this invention to provide a color picture tube with an in-line multi-stage focusing type electron gun assembly which can improve withstand voltage characteristics at low cost.

Figure 6A:
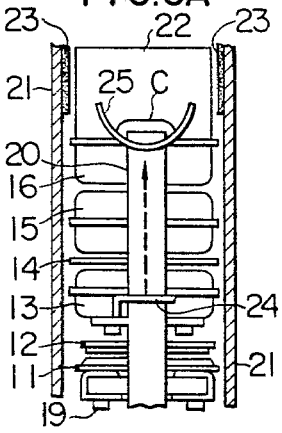
FIG. 6A is a front view to show an electron gun assembly embodying the invention.
Figure 6B:
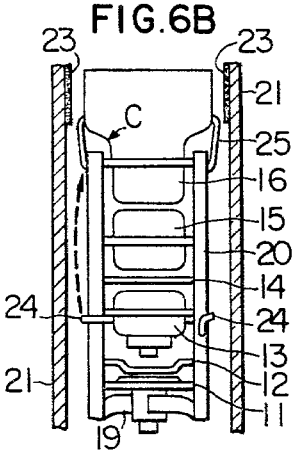
FIG. 6B is a side view of FIG. 6A.

An electron gun assembly embodying the invention as shown in FIGS. 6A and 6B is featured by the provision of metallic shielding members 25. The shielding member 25 is mounted to the shield cup 22, extending above the recessed portion C of the shield cup 22 to cover the end of the bead glass 20. The other members are designated by the same characters as those in FIGS. 5A and 5B. In the prior art tube as shown in FIGS. 5A and 5B, spark discharge occurs at an insufficiently shielded site in the electron gun with the recessed portion C of the shield cup 22 during the knocking treatment and the edge B of the inner graphite coating 23 sputters by being bombarded with a great number of electrons of high kinetic energy. In contrast, in this embodiment, even when spark discharge would occur and run along the same path, the majority of electrons will be caught by the metallic shielding member 25 which projects toward the lower potential side (base side) so that the inner graphite coating edge B is fairly prevented from being bombarded with the electrons.

Figure 7:
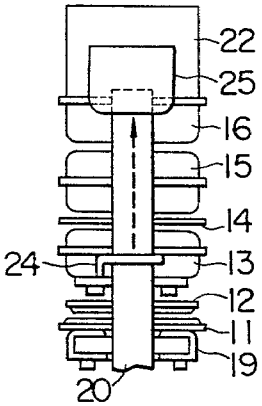
FIG. 7 is a diagrammatic representation to show another embodiment of the invention.

FIG. 7 shows another embodiment of the electron gun assembly comprising a metallic shielding member 25 in the form of a metal plate which substitute for the shielding member in the form of a metallic bent wire of the preceding embodiment.

Figure 8A:
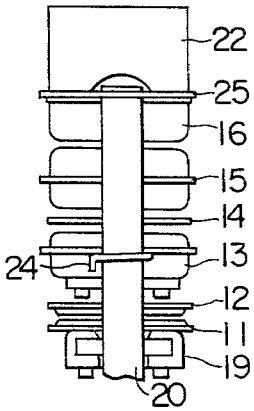
FIG. 8A is a front view of an electron gun assembly further embodying the invention.
Figure 8B:
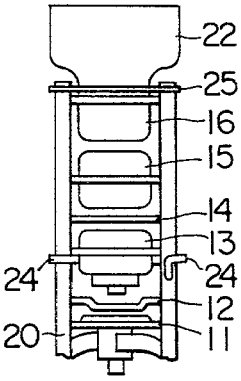
FIG. 8B is a side view of FIG. 8A.

FIGS. 8A and 8B show still another embodiment comprising a metallic shielding member 25 in the form of a metallic wire which, differing from the metallic bent wire of the embodiment of FIGS. 6A and 6B, surrounds the lower periphery of the shield cup 22.

Figure 9A:
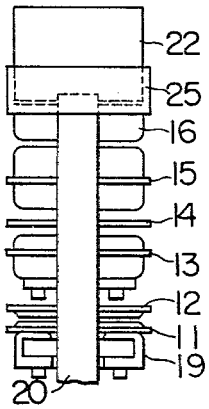
FIG. 9A is a front view of an electron gun assembly still further embodying the invention.
Figure 9B:
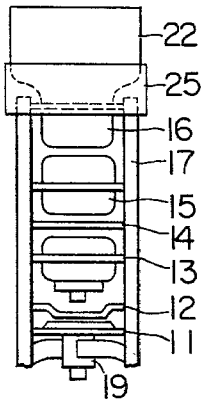
FIG. 9B is a side view of FIG. 9A.

FIGS. 9A and 9B show further embodiment comprising a metallic shielding member 25 in the form of a cylindrical strap which surrounds the lower periphery of the shield cup 22.

Figure 10:
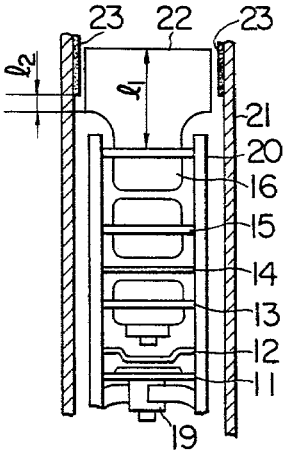
FIG. 10 is a diagrammatic representation to show still further embodiment of the invention.

FIG. 10 shows further embodiment comprising a shield cup 22 of a sufficiently large depth $l_1$ which includes, as shown in the figure, a large diameter portion and a small diameter portion fixed to a sixth grid electrode 16. The shield cup 22 is disposed with the lower end (base side) of the large diameter portion displaced, in the direction of the tube axis and toward the base, from the edge of the inner graphite coating 23 by a predetermined distance of $l_2$ or more. Experimentally, for a neck tube 21 of 29 mm outer diameter and a shield cup 22 of 22.5 mm outer diameter, the distance $l_2$ was about 4.5 mm. Similar calculations can be made for other tubes.

Figure 11A:
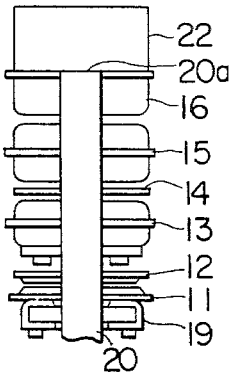
FIG. 11A is a front view of an electron gun assembly still further embodying the invention.
Figure 11B:
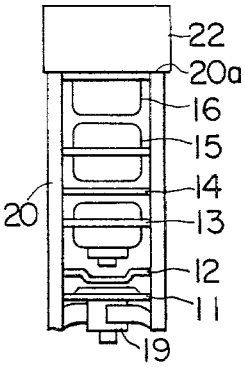
FIG. 11B is a side view of FIG. 11A.

FIGS. 11A and 11B show still further embodiment of electron gun assembly wherein one end 20*a* of bead glass 20 facing the fluorescent screen (in the fluorescent screen side) is substantially flush with one end of sixth grid electrode 16 in the fluorescent screen side, and the recessed portion C as in the previous embodiments is removed from a shield cup 22 of this embodiment. Thus, the shield cup 22 is of a uniform cylinder in this embodiment.

Although not shown, the flange of the sixth grid electrode 16 may be extended to terminate in an edge which lies in a gap between the bead glass 20 and the inner wall of neck tube and which acts as a shield.

From the standpoint of shielding effect, it is desirable that the gap between the inner wall of the neck tube and the metallic shielding member is as narrow as possible. But, the gap width is limited to ensure that electron gun assembly units mounted on the bead glass can be inserted smoothly into the neck tube without scratching the inner wall of the neck tube and to meet tolerance of parts and for assembling and ease of fabrication.

As described above, in accordance with the invention, it is possible to protect the inner graphite coating edge from being bombarded with electrons of high energy during the knocking treatment. But, if a spark discharge takes place on the same path, the metallic shielding member itself will be bombarded with high energy electrons. Under this condition, since the metallic material used for the electron gun is far stronger than the inner graphite coating, no serious sputtering is caused from the metallic shielding member by the bombardment of the electrons of high energy but of small momentum due to small mass of electrons.

In the foregoing description, the main theme was to prevent the discharge between the shield wire and the inner graphite coating. With electron gun assembly without the shield wire, discharge possibly takes place between the inner graphite coating and the first grid, second grid and cathode electrodes at lower potentials and teachings of the invention are obviously applicable to prevention of such a discharge.

Figure 12A:
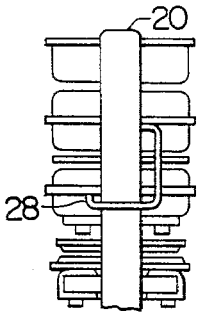
FIG. 12A is a front view of an electron gun assembly still further embodying the invention.
Figure 12B:
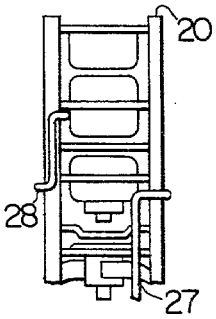
FIG. 12B is a side view of FIG. 12A.
Figure 12C:
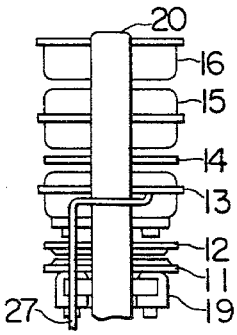
FIG. 12C is a rear view of FIG. 12A.

FIGS. 12A to 12C show still further embodiment of the invention which is consistent with reduction in the number of parts and the electron gun assembling process by dispensing with the shield wire. To this end, in this embodiment, at least one of focusing voltage feed conductors provided for third and fifth grid electrodes is so wired as to pass through the gap between the inner wall of the neck tube and the bead glass for supporting electron gun electrodes, thus providing the feed conductor with the function of the shield wire. In the figures, reference numerals 27 and 28 respectively designate feed conductors for the third and fifth grid electrodes in accordance with the invention. The other members are designated by the same characters as those in FIGS. 11A and 11B. The feed conductor 27 for the third grid electrode is bent at a portion thereof as shown in FIGS. 12B and 12C and runs through the gap between the bead glass 20 and the inner wall of the neck tube (not shown). This construction enables the feed conductor 27 to fulfil a similar function to the shield wire 24 shown in FIG. 3. The feed conductor 28 for the fifth grid electrode connecting the third grid electrode 13 to the fifth grid electrode 15 is so bent near one end connected to the third grid electrode 13 as to cross over the bead glass 20 as shown in FIGS. 12A and 12B and runs through the gap between the bead glass 20 and the inner wall of the neck tube (not shown). This construction enables the feed conductor 28 to fulfil a similar function to the shield wire 24 shown in FIG. 3. The construction of the feed conductors 27 and 28 in accordance with this embodiment is effective to prevent discharge between the fourth grid electrode and the first or second grid electrode or the cathode electrode. However, such construction is obviously applicable to the electron gun assembly without the metallic shielding member 25 as shown in FIGS. 6 to 10.

Figure 13A:
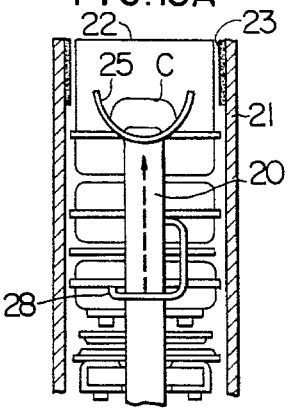
FIG. 13A is a front view of an electron gun assembly still further embodying the invention.
Figure 13B:
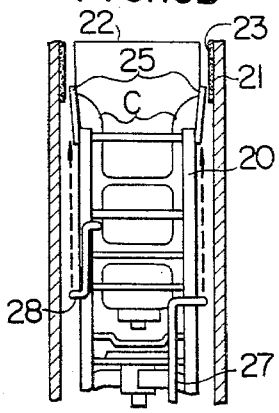
FIG. 13B is a side view of FIG. 13A.
Figure 13C:
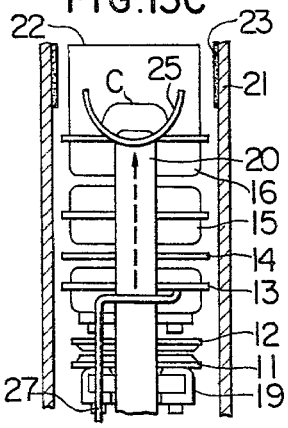
FIG. 13C is a rear view of FIG. 13A.

FIGS. 13A to 13C show still further embodiment wherein the embodiment of FIGS. 12A to 12C and the embodiment of FIGS. 6A and 6B are combined. This embodiment comprises, in place of the shield wire 24 of FIGS. 6A and 6B, feed conductors 27 and 28 provided respectively for third and fifth grid electrodes and constructed in accordance with the embodiment of FIGS. 12A to 12C. In FIGS. 13A to 13C, the other members are designated by the same characters as those in FIGS. 6A and 6B. According to this embodiment, secondary electrons coming from the feed conductors 27 and 28 are caught by the metallic shielding members 25, thereby protecting edge B of the inner graphite coating from being bombarded with the secondary electrons. It will be appreciated that the feed conductors 27 and 28 of this embodiment are obviously applicable to the embodiments of FIG. 7 through FIGS. 11A and 11B.

As having been described, the present invention advantageously prevents the sputtering of the inner graphite coating powders during the knocking treatment and provides the color picture tube with the in-line multi-stage focusing type electron gun assembly which is improved in withstand voltage characteristics.

Moreover, in accordance with the invention, it is possible to eliminate the shield wire by providing the feed conductors 27 and 28 of unique construction for the third and fifth grid electrodes, thereby providing the color picture tube with the in-line type electron assembly at low cost.

Also, even with the electron gun assembly wherein at least one of the grid feed conductors 27 and 28 cannot be wired to cross over the bead glass, it is possible to eliminate at least one of the shield wire 24, thereby reducing the number of parts and the fabrication process.

Furthermore, the invention provides the color picture tube with the in-line multi-stage focusing electron gun assembly which can prevent the sputtering of the inner graphite coating powders and dispense with the shield wire and which can be inexpensive and improved in withstand voltage characteristics.

What we claim is:

1. A color picture tube with an in-line multi-stage focusing type electron gun assembly including an envelope having a neck tube; a group of electrodes contained in the neck tube and having a successive arrangement including a cathode electrode, at least one grid electrode to which is applied a focusing voltage and at least one grid electrode to which is applied an anode voltage; bead glass means for supporting these electrodes at predetermined spacings; an inner graphite coating formed on the inner wall of the neck tube and to which is applied the anode voltage; a shield cup secured and electrically connected to said grid electrode to which is applied the anode voltage; and metallic shielding means for electrostatically shielding said inner graphite coating from the electrodes which are at potentials lower than the anode voltage, said metallic shielding means being at the anode voltage level and being located nearer to the base of said electron gun assembly as compared with the distance between said base and said inner graphite coating.

2. A color picture tube according to claim 1, wherein said electron gun assembly comprises an electrically-conductive shield wire having one end secured to at least one of the grid electrodes applied with the focusing voltage, the other end of which runs through a gap between the bead glass means and the inner wall of the neck tube.

3. A color picture tube according to claim 1, wherein said electron gun asembly comprises a focusing voltage feed conductor for feeding the focusing voltage to at least one of said grid electrode to be applied with the focusing voltage, said feed conductor being wired such that said feed conductor runs through a gap between the inner wall of said neck tube and said bead glass means.

4. A color picture tube according to claim 1, wherein said shield cup comprises a large diameter portion and a small diameter portion secured to one of the grid electrodes, one end of said large diameter portion facing the base of the electron gun assembly being located nearer to the base of said electron gun assembly as compared with a distance between said base and said inner graphite coating, whereby said one end of said large diameter portion of said shield cup serves as a metallic shielding means.

5. A color picture tube according to claim 1, 2 or 3, wherein said metallic shield means comprises a cylindrical metal strap which is mounted to said shield cup to surround the lower periphery thereof.

6. A color picture tube according to claim 1, 2 or 3, wherein said metallic shielding means comprises a metallic bent wire, said bent wire being mounted to said shield cup and extending above a recessed portion of the shield cup with its bent inside portion directed toward the base.

7. A color picture tube according to claim 1, 2 or 3, wherein said metallic shield means comprises a metal plate which is mounted to said shield cup and to cover at least a recessed portion of the shield cup.

8. A color picture tube according to claim 1, 2 or 3, wherein said metallic shield means comprises a metal wire which is mounted to said shield cup and to surround the lower periphery of the shield cup.

9. A color picture tube according to claim 1 wherein said shield cup comprises a circular bottom surface, and one end of said bead glass means and one end of the grid electrode supplied with the anode voltage are disposed to abut said circular bottom surface, said circular bottom surface facing the base of the electron gun assembly and being located nearer to the base of said electron gun assembly as compared with a distance between said base and said inner graphite coating, whereby the periphery of said circular bottom surface of said shield cup serves as said metallic shielding means.

* * * * *

UNITED STATES PATENT AND TRADEMARK OFFICE

CERTIFICATE OF CORRECTION

PATENT NO. : 4,350,924

DATED : September 21, 1982

INVENTOR(S) : Masayoshi Misono

It is certified that error appears in the above-identified patent and that said Letters Patent is hereby corrected as shown below:

On the title page Insert

-- (30) Foreign Application Priority Data

| | | |
|---|---|---|
| October 18, 1978 | Japan | 53-127334 |
| October 20, 1978 | Japan | 53-143471 -- |

Signed and Sealed this

*Fifteenth* Day of *February 1983*

[SEAL]

*Attest:*

*Attesting Officer*

GERALD J. MOSSINGHOFF

*Commissioner of Patents and Trademarks*